US011320778B2

(12) United States Patent
Ichiyanagi et al.

(10) Patent No.: US 11,320,778 B2
(45) Date of Patent: May 3, 2022

(54) IMAGE FORMING APPARATUS HAVING COVER WITH MANEUVER LEVER FOR ACTUATING LOCKING MEMBERS

(71) Applicant: BROTHER KOGYO KABUSHIKI KAISHA, Nagoya (JP)

(72) Inventors: Masao Ichiyanagi, Aichi (JP); Hikaru Iino, Aichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/170,270

(22) Filed: Feb. 8, 2021

(65) Prior Publication Data

US 2021/0247716 A1 Aug. 12, 2021

(30) Foreign Application Priority Data

Feb. 10, 2020 (JP) ..... JP2020-020302

(51) Int. Cl.
*G03G 21/00* (2006.01)
*G03G 21/16* (2006.01)

(52) U.S. Cl.
CPC . *G03G 21/1633* (2013.01); *G03G 2221/1687* (2013.01)

(58) Field of Classification Search
CPC ..... G03G 21/1633; G03G 21/1628; G03G 2221/1654; G03G 2221/1687; G03G 2221/169
USPC ..... 399/107, 125
See application file for complete search history.

(56) References Cited

U.S. PATENT DOCUMENTS

| | | | | |
|---|---|---|---|---|
| 10,016,996 | B2 * | 7/2018 | Iketani | G03G 21/1647 |
| 2011/0242626 | A1 | 10/2011 | Nagashima | |
| 2013/0259515 | A1 * | 10/2013 | Mori | G03G 21/1633 399/107 |
| 2013/0287434 | A1 | 10/2013 | Hisano | |
| 2016/0187839 | A1 | 6/2016 | Ueyama et al. | |
| 2017/0315499 | A1 | 11/2017 | Maeda | |
| 2018/0052419 | A1 * | 2/2018 | Maeda | G03G 21/1842 |

(Continued)

FOREIGN PATENT DOCUMENTS

| | | | |
|---|---|---|---|
| JP | 2001267764 | A | 9/2001 |
| JP | 2006102949 | A | 4/2006 |
| JP | 2007328302 | A | 12/2007 |

(Continued)

*Primary Examiner* — Robert B Beatty
(74) *Attorney, Agent, or Firm* — Merchant & Gould P.C.

(57) ABSTRACT

An image forming apparatus includes a housing, a cover, a maneuver lever, a first locking member, and a second locking member. The cover is attached to the housing and is rotatable about a rotation axis. The maneuver lever is attached to the cover and extends parallel to the rotation axis. The first and second locking members are attached to the cover and are configured to engage with the maneuver lever. The first locking member is rotatable about a first axis perpendicular to the rotation axis between a locked position and an unlocked position. The second locking member is rotatable about a second axis parallel to the first axis between a locked position and an unlocked position. When the maneuver lever moves from the closed position to the open position, each of the first locking member and the second locking member rotates from the locked position to the unlocked position.

18 Claims, 10 Drawing Sheets

(56) References Cited

U.S. PATENT DOCUMENTS

| | | | | |
|---|---|---|---|---|
| 2018/0095408 | A1* | 4/2018 | Tsuchiya | H04N 1/00551 |
| 2019/0227478 | A1* | 7/2019 | Kikura | B41J 29/02 |

FOREIGN PATENT DOCUMENTS

| | | | | |
|---|---|---|---|---|
| JP | 2012175059 | A | * | 9/2012 |
| JP | 2013242535 | A | | 12/2013 |
| JP | 2014010298 | A | | 1/2014 |
| JP | 2014157368 | A | | 8/2014 |
| JP | 2016124114 | A | | 7/2016 |
| JP | 2016126027 | A | | 7/2016 |
| JP | 2017198857 | A | | 11/2017 |

* cited by examiner

IMAGE FORMING APPARATUS HAVING COVER WITH MANEUVER LEVER FOR ACTUATING LOCKING MEMBERS

CROSS-REFERENCE TO RELATED APPLICATION(S)

This application claims priority from Japanese Patent Application No. 2020-020302 filed on Feb. 10, 2020, the disclosure of which is incorporated herein by reference in its entirety.

TECHNICAL FIELD

The present invention relates to an image forming apparatus.

BACKGROUND ART

An image forming apparatus known in the art comprises a cover which can be opened and closed to allow maintenance and/or replacement of components arranged inside a housing of the apparatus. For example, the cover is attached to the housing of the apparatus in such a manner that it is rotatable about a horizontally-extending rotation axis. When the cover is closed, the cover is locked to the housing by a locking mechanism.

An exemplary image forming apparatus comprises a maneuver lever attached to the cover, and locking members attached to both ends of the maneuver lever. The maneuver lever extends parallel to a rotation axis of the cover and is rotatable. The locking members are slidable in directions parallel to the rotation axis of the cover. When the maneuver lever rotates between a closed position and an open position, each of the locking members slides between a locked position located away from the maneuver lever and an unlocked position closer to the maneuver lever. The locking members are biased to the locked positions respectively by springs.

SUMMARY

In the above-described exemplary image forming apparatus, the space necessary for movement of the locking members in a direction perpendicular to the rotation axis of the cover can be reduced compared to an apparatus in which locking members are attached to both ends of a maneuver lever and rotate with the maneuver lever. However, since it is necessary to slide the locking members inwardly against biasing forces of the springs to open the cover, the force necessary to open the cover is relatively large which decreases the maneuverability of the cover.

It would be desirable to provide an image forming apparatus having a locking mechanism in which a space necessary for movement of the locking members in a direction perpendicular to a rotation axis of a cover and the force necessary to open and close the cover is reduced.

In one aspect, an image forming apparatus is disclosed herein, that comprises a housing, a cover attached to the housing, a maneuver lever attached to the cover, a first locking member attached to the cover, and a second locking member attached to the cover. The cover is rotatable about a rotation axis with respect to the housing. The maneuver lever extends parallel to the rotation axis, and is movable between a closed position and an open position. The maneuver lever has a first end and a second end that are located apart from each other in a direction parallel to the rotation axis. The first locking member is configured to engage with the first end of the maneuver lever. The first locking member is rotatable about a first axis perpendicular to the rotation axis between a locked position and an unlocked position. The second locking member is configured to engage with the second end of the maneuver lever. The second locking member is rotatable about a second axis parallel to the first axis between a locked position and an unlocked position.

When the maneuver lever moves from the closed position to the open position, each of the first locking member and the second locking member rotates from the locked position to the unlocked position.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

A detailed description will be given of a non-limiting embodiment with reference made to the drawings where appropriate. A general structure of a color printer as an example of an image forming apparatus will be given to begin with, and a description of the features of the present invention will be given afterwards.

Figure 1:
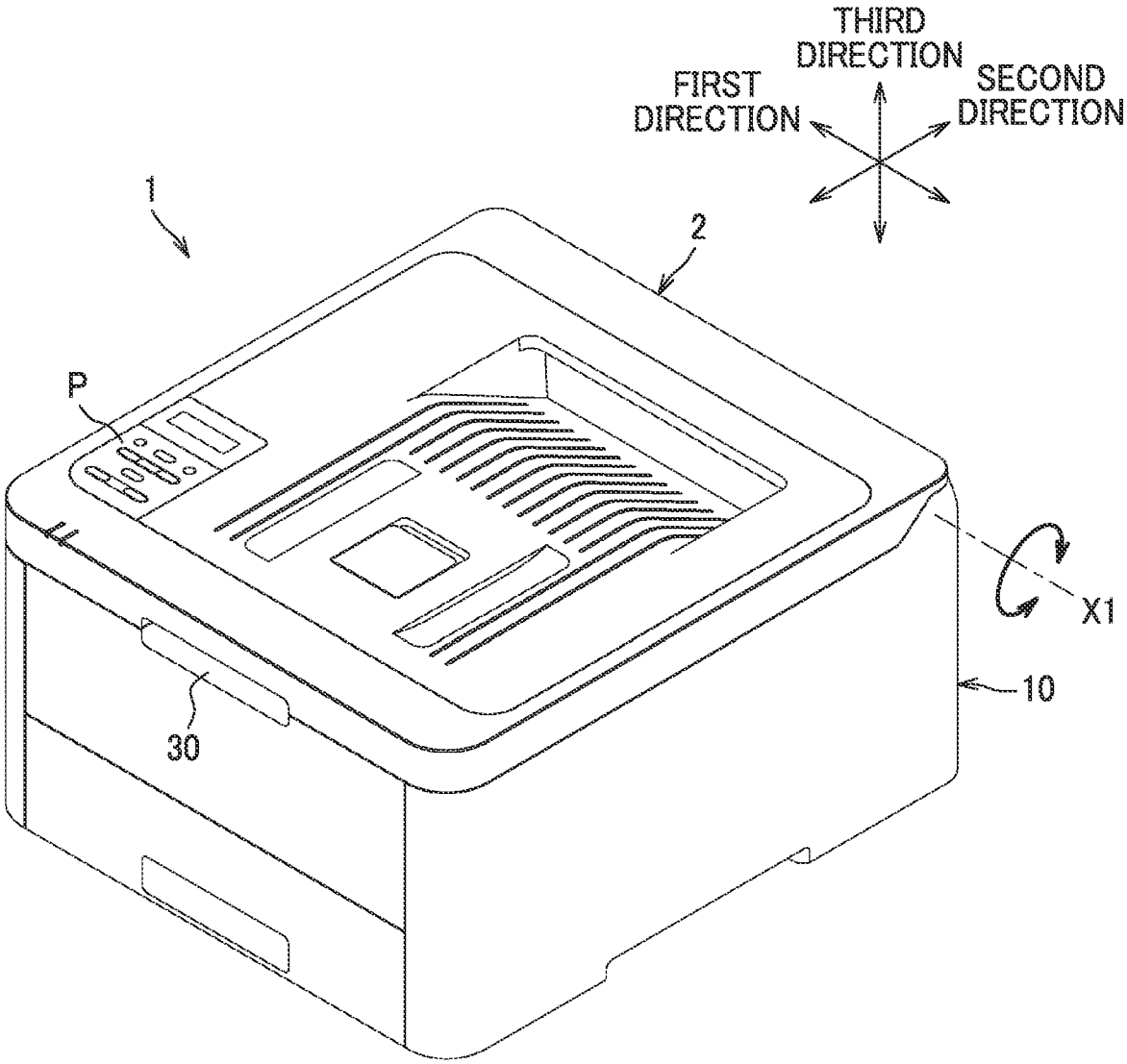
FIG. 1 is a perspective view of a color printer of an embodiment of the present invention.

As shown in FIG. 1, a color printer 1 comprises a housing 10, a top cover 2 as an example of a cover and various components for forming an image on a sheet S (e.g., of paper). The top cover 2 covers an opening of the housing 10 and can be opened and closed for maintenance and/or replacement of the components arranged inside the housing 10. The top cover 2 is attached to the housing 10 and is rotatable about a rotation axis X1 with respect to the housing 10. A top surface of the top cover 2 is provided with a control panel P. In this description, directions parallel to the rotation axis X1 of the top cover 2 is also simply referred to as "first direction".

Figure 2:
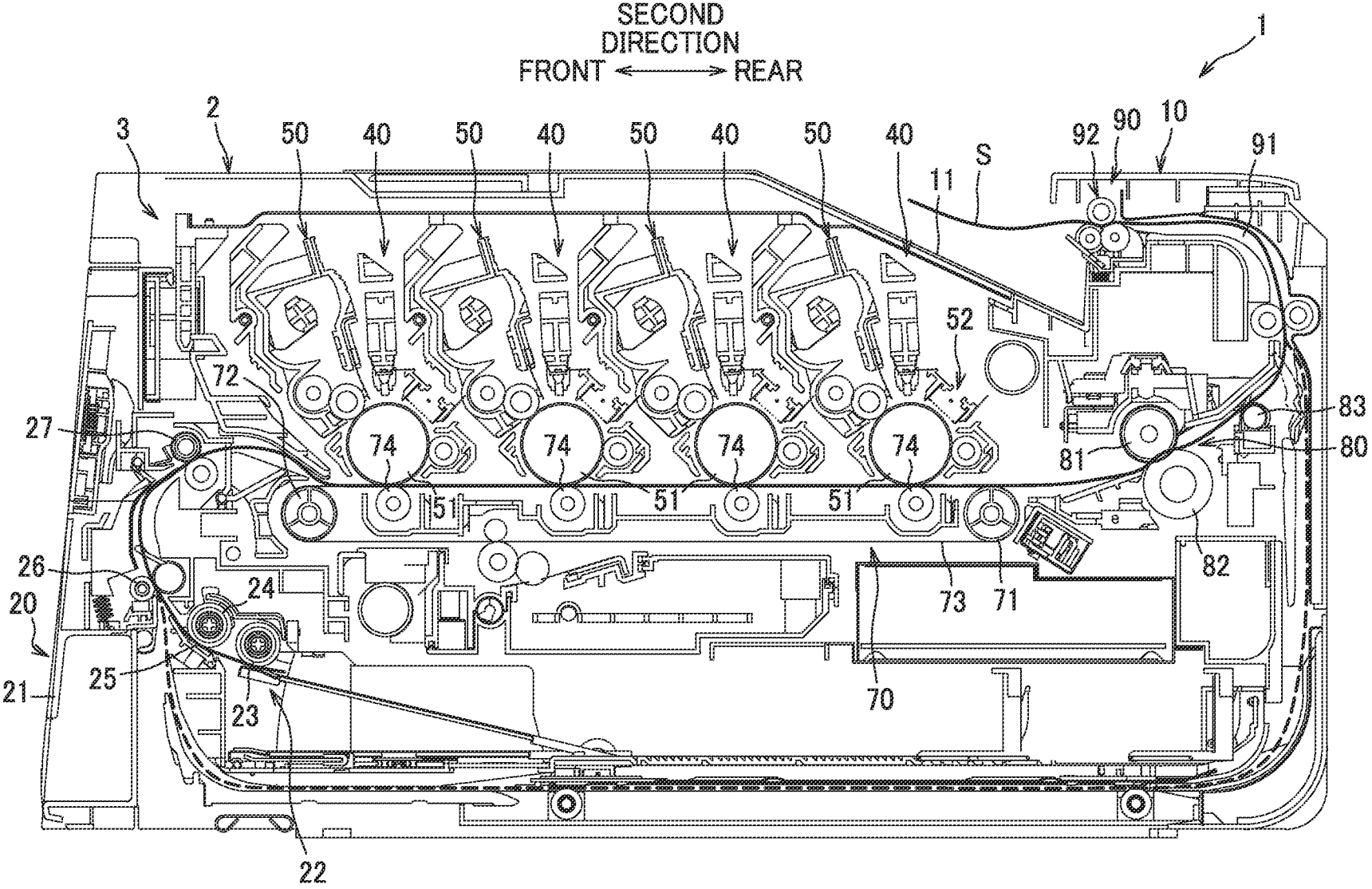
FIG. 2 is a sectional view of the color printer.

As shown in FIG. 2, the color printer 1 is capable of forming images on both sides of a sheet S. The color printer 1 mainly comprises a feeder unit 20, an image forming unit 3, and a conveying unit 90 arranged inside the housing 10.

In this description, directions will be described as seen from a user using the color printer 1. That is, in FIG. 2, the left side of the drawing sheet corresponds to the "front side", the right side of the drawing sheet corresponds to the "rear side", the back side of the drawing sheet corresponds to the "left side" and the front side of the drawing sheet corresponds to the "right side". The direction toward the upper side of the drawing sheet corresponds to "upward", and the direction toward the lower side of the drawing sheet corresponds to "downward".

The housing 10 comprises an output tray 11 on the top surface. Sheets S with images formed thereon are ejected from the housing 10 and staked on the output tray 11.

The feeder unit 20 is arranged in the lower part of the housing 10. The feeder unit 20 mainly comprises a sheet tray 21, and a feeding mechanism 22. The feeding mechanism 22 is provided on the front side of the sheet tray 21 and comprises a feed roller 23, a separator roller 24, a separator pad 25, a paper dust remover roller 26, and a registration roller 27.

The sheets S held in the sheet tray 21 are turned from the front to the rear of the housing 10 by the feeding mechanism 22 and fed to the image forming unit 3. The sheet tray 21 can be removed from the housing 10 by pulling the sheet tray 21 toward the front, and can be installed in the housing 10 by pushing the sheet tray 21 toward the rear. The sheet tray 21 extends from the front end to the rear end in the lower part of the housing 10.

The image forming unit 3 is arranged above the sheet tray 21 and forms an image on a sheet S conveyed from the feeder unit 20. The image forming unit 3 mainly comprises four LED units 40, four processing units 50, a transferring unit 70, and a fixing unit 80.

Each LED unit 40 comprises a plurality of LEDs on a lower end thereof and is positioned above and opposed to a corresponding photoconductor drum 51 described later. Each LED unit 40 is configured such that the plurality of LEDs flash in accordance with image data, to thereby expose a surface of the corresponding photoconductor drum 51 to light.

The process units 50 are arranged side by side in the front-rear direction. Each process unit 50 mainly comprises the photoconductor drum 51, a charger 52, a development roller, a supply roller, a doctor blade, and a toner container (reference characters thereof omitted in the drawings).

The transferring unit 70 is located between the sheet tray 21 and the process units 50. The transferring unit 70 mainly comprises a conveyer belt 73 and four transfer rollers 74. The conveyor belt 73 is an endless belt that is looped around and runs between a drive roller 71 and a follower roller 72. The outer surface of the conveyer belt 73 contacts each photoconductor drum 51. The transfer rollers 74 are positioned on the inner side of the conveyor belt 73. The conveyor belt 73 is held between the transfer rollers 74 and corresponding photoconductor drums 51.

The fixing unit 80 is arranged on the rear side of the process unit 50 and mainly comprises a heating roller 81, and a pressure roller 82. The pressure roller 81 is opposed to the heating roller 81 and presses the heating roller 81.

In the image forming unit 3, the surface of each photoconductor drum 51 is charged by the charger 52. Thereafter, light from the LED unit 40 exposes the surface of the photoconductor drum 51 to light to form an electrostatic latent image on the photoconductor drum 51 in accordance with image data. Toner in the toner container is supplied to the development roller via the supply roller, enters a gap between the development roller and the doctor blade, and is carried on the development roller as a thin layer with a constant thickness The toner carried on the development roller is supplied to the electrostatic latent image formed on the photoconductor drum 51. Accordingly, the electrostatic latent image is visualized and forms a toner image on the photoconductor drum 51. Thereafter, a sheet S fed from the feeder unit 20 is conveyed through between the photoconductor drum 51 and the conveyer belt 73 (transfer rollers 74), so that the toner images (of different colors, e.g. cyan, magenta, yellow, and black) formed on the photoconductor drums 51 are successively transferred to and overlapped on the sheet S to form a multicolor toner image.

The sheet S with the toner image is conveyed through between the heating roller 81 and the pressure roller 82, which causes the toner image to be thermally fixed on the sheet S. In this way, an image can by formed on the sheet S. The sheet S with an image formed thereon is conveyed from the fixing unit 80 to the conveyance path 91 by a conveyor roller 83.

The conveying unit 90 functions as an ejection mechanism that ejects a sheet S conveyed from the image forming unit 3 to the outside of the housing 10, as well as a reconveyance mechanism that causes a sheet S with an image formed on one side by the image forming unit 3 to be turned upside down and conveyed to the image forming unit 3 again. Specifically, the conveying unit 90 mainly comprises a conveyance path 91 and ejection rollers 92.

Next, the locking mechanism for the top cover 2 will be described.

Figure 3:
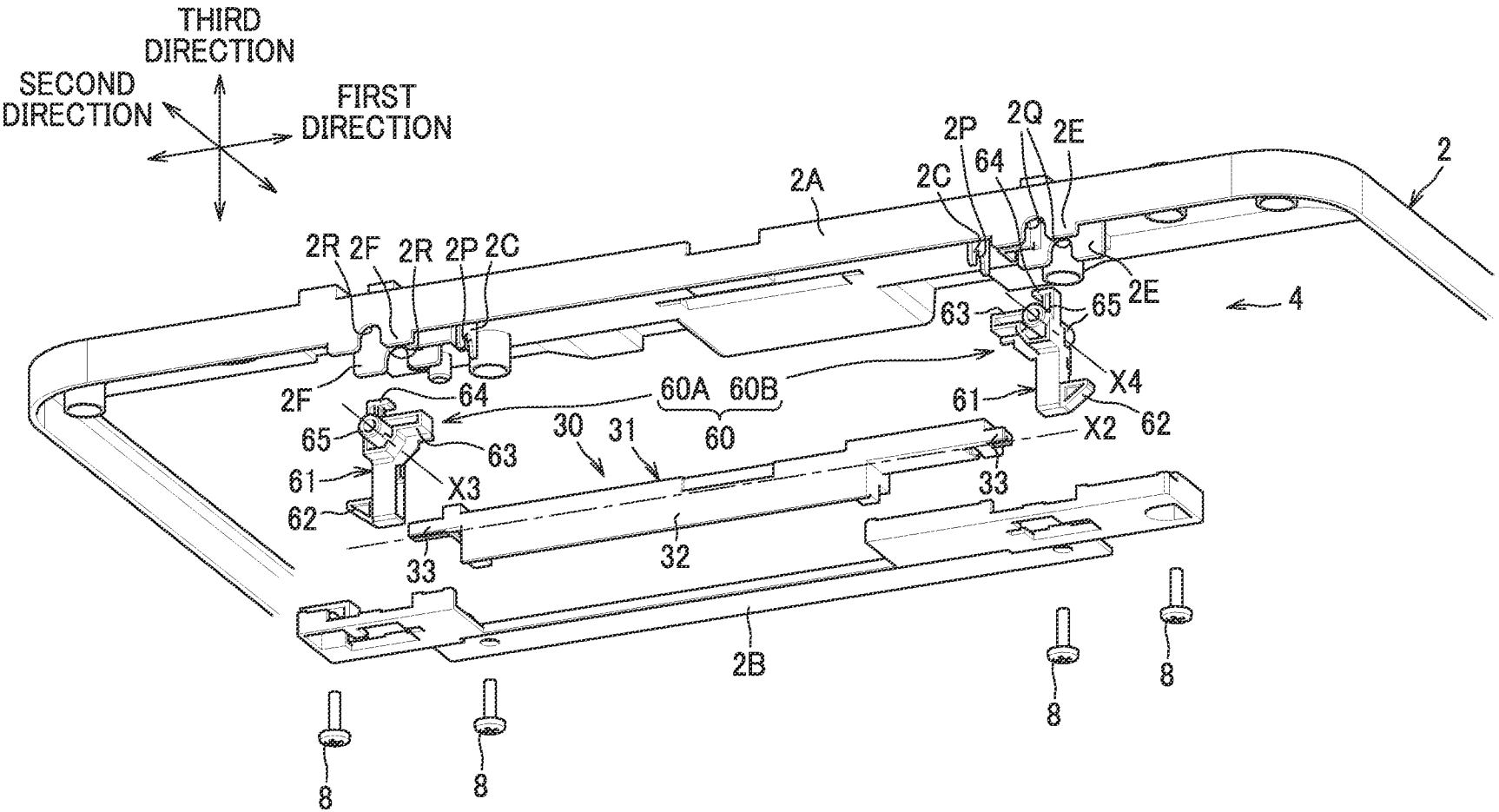
FIG. 3 is an exploded perspective view showing a locking mechanism for a top cover.

As shown in FIG. 3, the locking mechanism 4 comprises a maneuver lever 30, and locking members 60.

The top cover 2 comprises a first frame 2A, and a second frame 2B fixed to the first frame 2A by screws 8. The first frame 2A comprises a pair of lever supporting sections 2C located apart from each other in the first direction. Each lever supporting section 2C includes a recess 2P configured to support the maneuver lever 30. The bottoms of the recesses 2P have semicircular configurations with centers thereof positioned on a common axis parallel to the first direction. The first frame 2A further comprises a pair of first lock supporting sections 2E and a pair of second lock supporting sections 2F. The pair of first lock supporting sections 2E and the pair of second lock supporting sections 2F are located apart from each other in the first direction. Each first lock supporting section 2E includes a recess 2Q configured to support a corresponding locking member 60B. Each second lock supporting section 2F includes a recess 2R configured to support a corresponding locking member 60A. The bottoms of the recesses 2Q have semicircular configurations with centers thereof positioned on a common axis perpendicular to the first direction. The bottoms of the recesses 2R have semicircular configurations with centers thereof positioned on a common axis perpendicular to the first direction.

The maneuver lever 30 and the locking members 60 are attached to the first frame 2A by means of the second frame 2B.

The maneuver lever 30 has a shape elongate in the first direction and is rotatable between a closed position and an open position about a lever axis X2 extending in the first direction. The maneuver lever 30 has a first end and a second end that are located apart from each other in the first direction. The maneuver lever 30 comprises a lever body 31, a maneuver section 32, and lever contact sections 33. A first lever contact section 33 is provided on the first end of the maneuver lever 30 and a second lever contact section 33 is provided on the second end of the maneuver lever 30.

Figure 4:
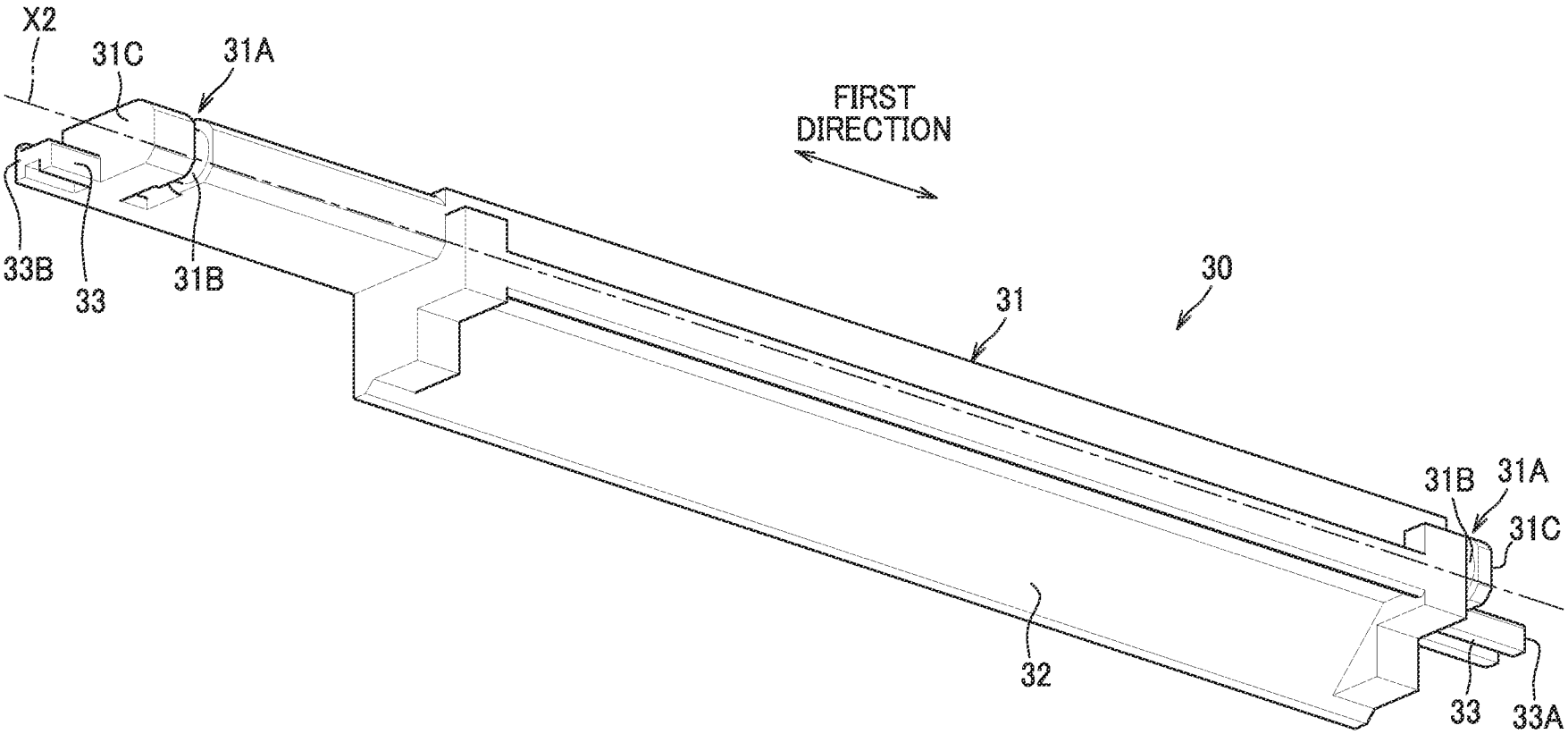
FIG. 4 is a perspective view showing the rear side of a maneuver lever.

As shown in FIG. 4, the lever body 31 has a rectangular parallelepiped shape elongate in a direction parallel to the lever axis X2. Each end of the lever body 31 includes a notch 31A on a rear side. Cylindrical shafts 31B of which axes coincide with the lever axis X2 are formed inside each notch 31A.

Figure 5A:
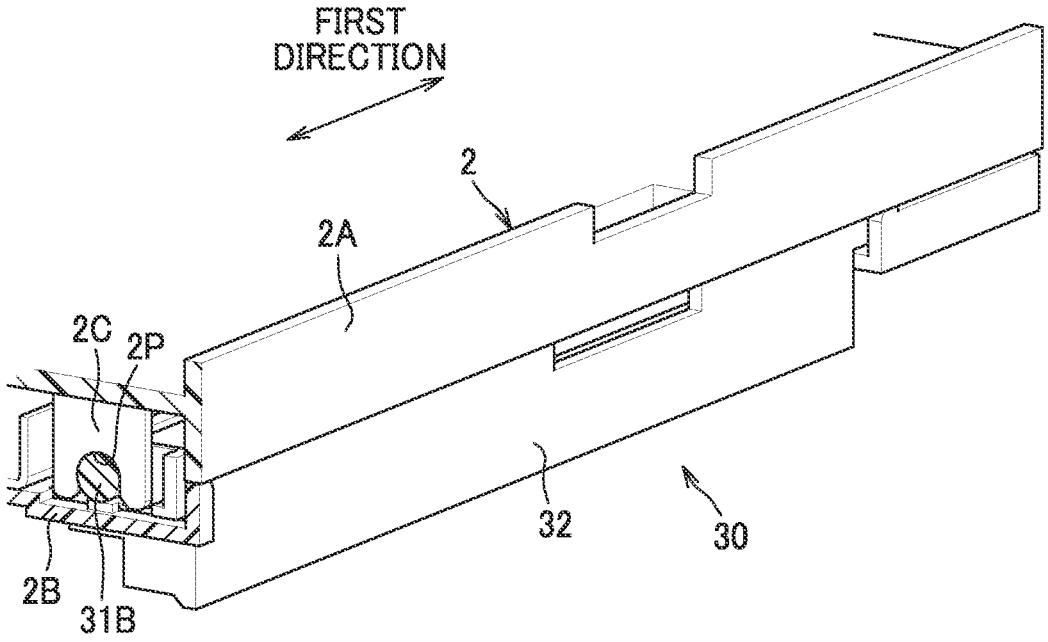
FIG. 5A is a perspective view of the cover and the maneuver lever broken at one shaft.
Figure 5B:
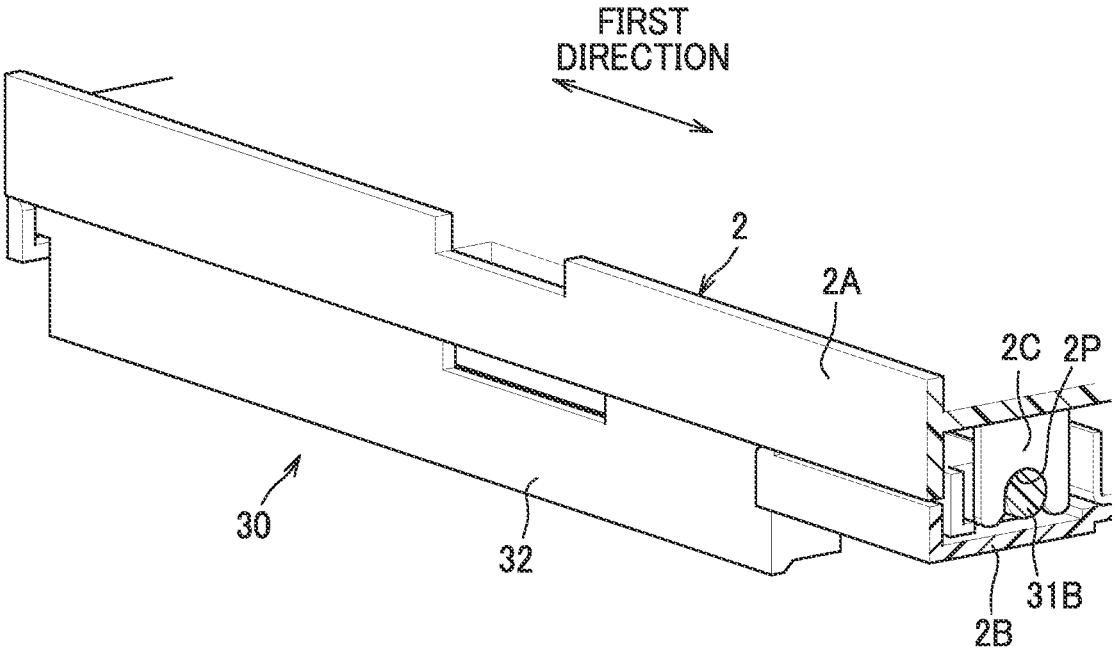
FIG. 5B is a perspective view of the cover and the maneuver lever broken at the other shaft.

As shown in FIG. 5, each shaft 31B is placed in the recess 2P of the corresponding lever supporting section 2C and held between the lever supporting section 2C and the second frame 2B.

Returning to FIG. 4, the maneuver section 32 is shaped like a plate that a person manipulates by his/her hand to open the top cover 2. The maneuver section 32 extends from the lever body 31 in a direction perpendicular to the lever axis X2. An angle defined by the term "Perpendicular" is not necessarily exactly 90 degrees, but may be in the neighborhood of 90 degrees. For example, the angle may be 90 degrees±5 degrees. A shortest distance L1 (see FIG. 6) between the maneuver section 32 and an end face 33A of the first lever contact section 33 is shorter than a shortest distance L2 between the maneuver section 32 and an end face 33B of the second lever contact section 33. That is, the maneuver section 32 is provided in a shifted position, closer to the first end than to the second end of the maneuver lever 30 so as to leave a space for the operation panel P (see FIG. 1).

Each of the lever contacting sections 33 contacts a corresponding locking member 60 as will be described later. The lever contacting portions 33 protrude in the first direction from end faces 31C of the lever body 31. The lever contacting portions 33 are out of alignment with the lever axis X2.

As shown in FIG. 3, there are two locking members 60. In this description, the left locking member is referred to as "first locking member 60A" and the right locking member is referred to as "second locking member 60B". Since the structure of the second locking member 60B is symmetrical to the structure of the first locking member 60A, the parts of the second locking member 60B similar to those of the first locking member 60A will be identified by the same reference characters and descriptions thereof will be omitted.

The locking member 60A comprises a lock body 61, a latch section 62, a contact section 63, a stopper 64, and a shaft section 65.

Figure 6A:
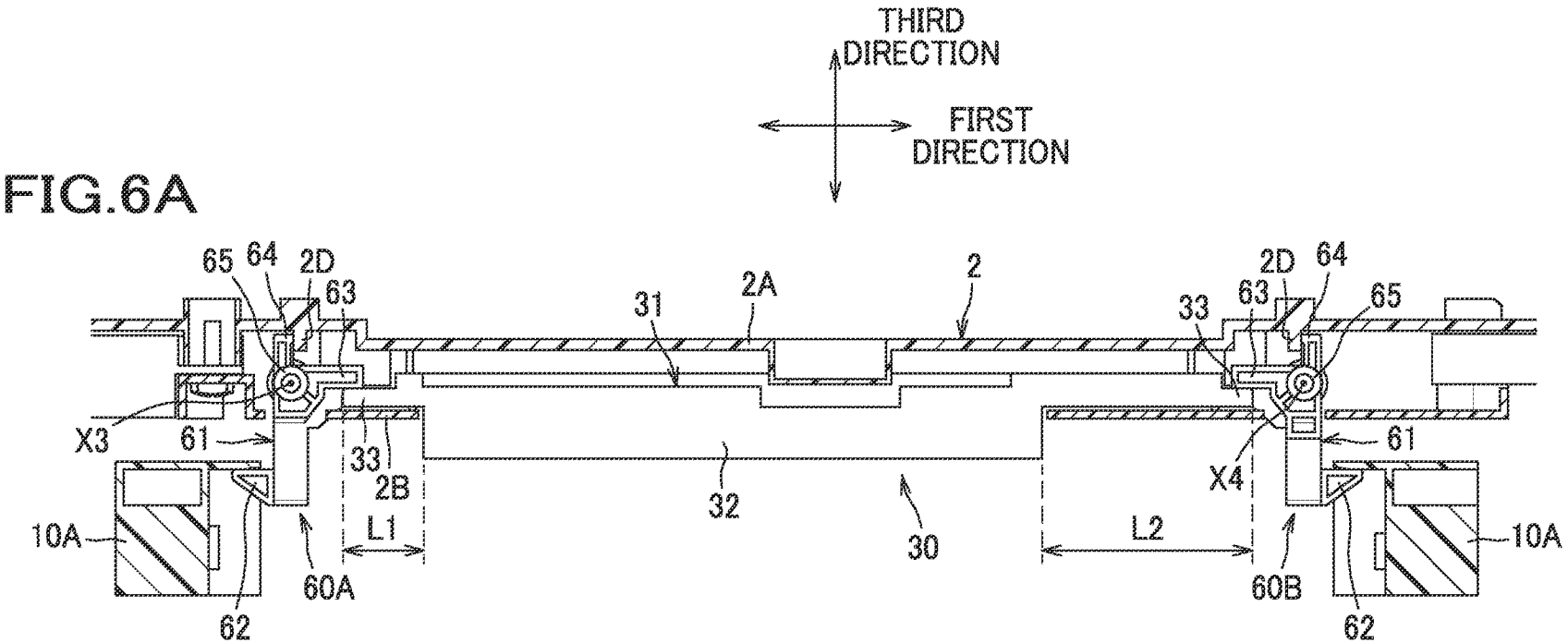
FIG. 6A is a sectional view showing a locked state of the locking mechanism.

As shown in FIG. 6A, the lock body 61 has an elongated rectangular parallelepiped shape and is rotatable about the shaft section 65.

When the locking member 60A is in a locked position, the latch section 62 engages with an engagement section 10A formed in the housing 10 (see FIG. 6). The latch section 62 extends outward from one end of the lock body 61 in a direction away from the maneuver lever 30.

The contact section 63 contacts the first lever contact section 33 of the maneuver lever 30. The contact section 63 extends from the other end of the lock body 61 toward the lever 30.

Figure 7:
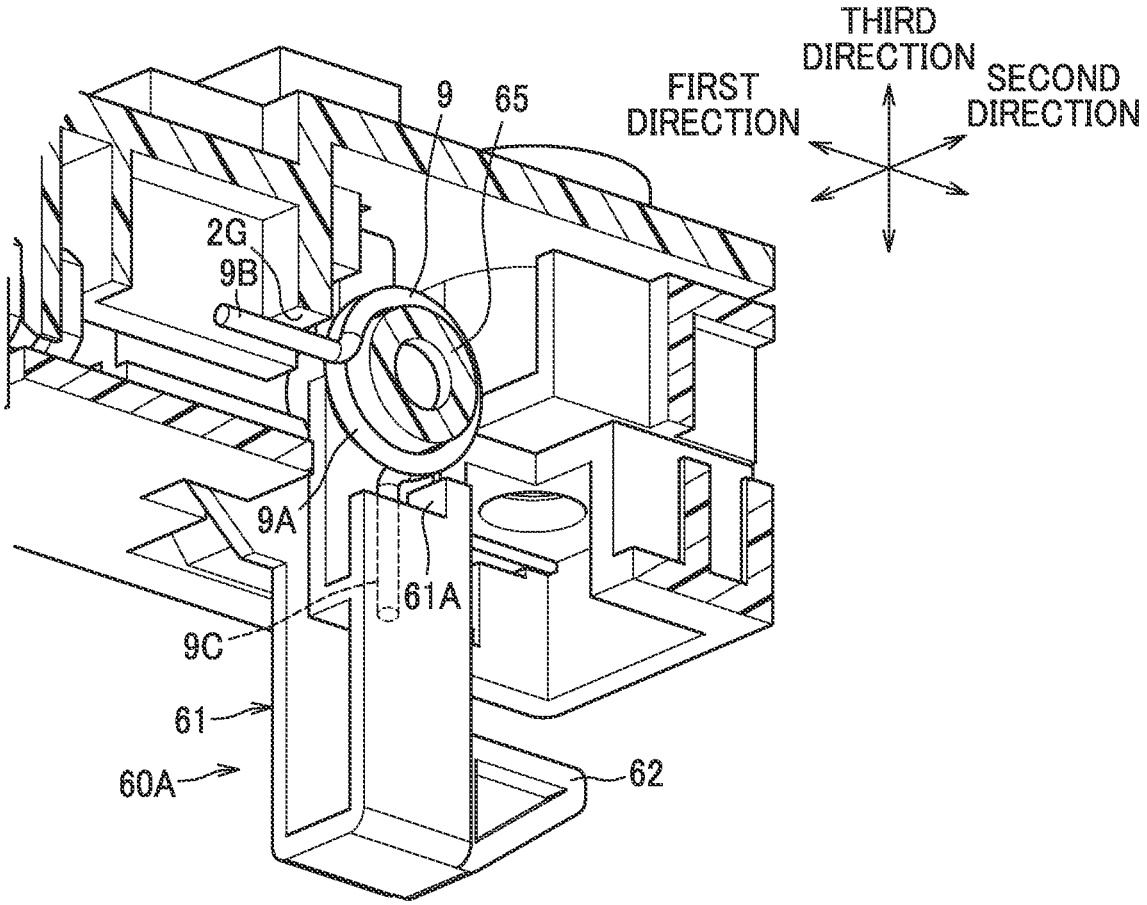
FIG. 7 is a broken perspective view of a locking member attached to the top cover from the rear side and showing the locking member biased and retained at the locked position by a spring.

The stopper 64 contacts a protrusion 2D that protrudes from an inner surface of the top cover 2, to stop rotation of the locking member 60A caused by a biasing force of a spring 9 (see FIG. 7). The stopper 64 extends from the lock body 61 toward the top cover 2.

The shaft section 65 is rotatably supported on the cover 2. The shaft section 65 extends in a second direction perpendicular to the first direction at the other end of the lock body 61. The axis of the shaft section 65 coincides with an axis of rotation of the locking member 60A.

As shown in FIG. 7, the first locking member 60A is biased and retained at the locked position by the spring 9. The spring 9 is a torsion spring such as a helical torsion spring and comprises a coil 9A, a first arm 9B, and a second arm 9C. The coil 9A is located around the shaft section 65 of the first locking member 60A. The first arm 9B extends from the coil 9A and engages with a surface 2G of the top cover 2. The second arm 9C extends from the coil 9A and engages with a surface 61A of the lock body 61. The second locking member 60B is biased by a spring 9 (not shown) and retained at the locking position in a similar manner as the first locking member 60A. The spring 9 biasing the first locking member 60A corresponds to "first spring" and the spring 9 biasing the second locking member 60B corresponds to "second spring".

Returning to FIG. 3, each end of the shaft section 65 of the first locking member 60A is placed in the recess 2R of a corresponding lock supporting section 2F and held between the corresponding lock supporting section 2F and the second frame 2B. The contact section 63 of the first locking member 60A contacts the first lever contact section 33 of the maneuver lever 30.

Each end of the shaft section 65 of the second locking member 60B is placed in the recess 2Q of a corresponding lock support section 2E and held between the corresponding lock support section 2E and the second frame 2B. The contact section 63 of the second locking member 60B contacts the second lever contact section 33 of the maneuver lever 30.

According to the above-described structure, the first locking member 60A is configured to be rotatable about a first axis X3 between the locked position and an unlocked position. The second locking member 60B is configured to be rotatable about a second axis X4 between a locked position and an unlocked position. The axes X3, X4 of the locking members 60A, 60B are perpendicular to the rotation axis X1 of the top cover 2 and to the lever axis X2. The "perpendicular" angles formed between the axes are not necessarily exactly 90 degrees, but may be in the neighborhood of 90 degrees. For example, the angles may be 90 degrees±5 degrees.

The top cover 2, the maneuver lever 30, and the locking members 60 are formed by injection molding from plastic, for example.

The operation of the locking mechanism 4 will now be described.

Figure 8A:
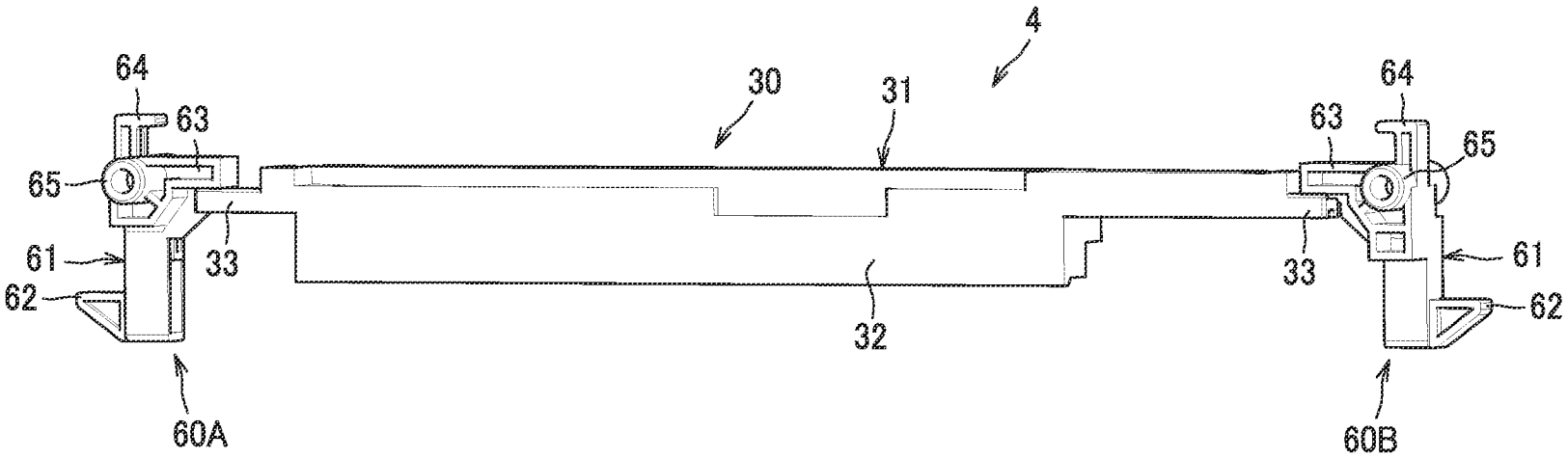
FIG. 8A is a perspective view showing a locked state of the locking mechanism.

As shown in FIGS. 6A and 8A, when the locking mechanism 4 is in the locked state, the maneuver lever 30 is in the closed position. The latch sections 62 of the locking members 60A, 60B are biased by respective springs 9 to the locked positions in which the latch sections 62 are in contact with corresponding engagement sections 10A. The contact sections 63 of the locking members 60A, 60B are in contact with corresponding lever contact sections 33.

Figure 6B:
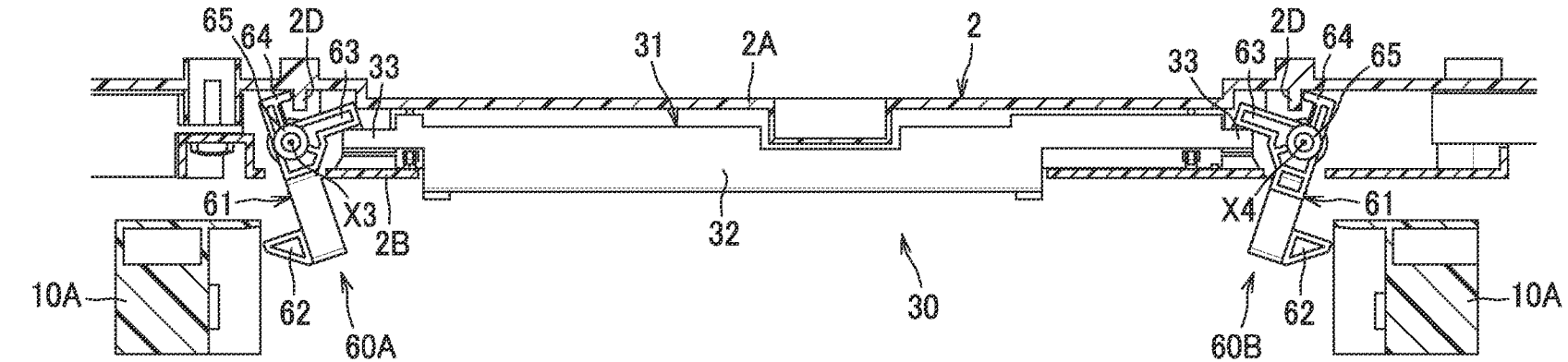
FIG. 6B is a sectional view showing an unlocked state of the locking mechanism.
Figure 8B:
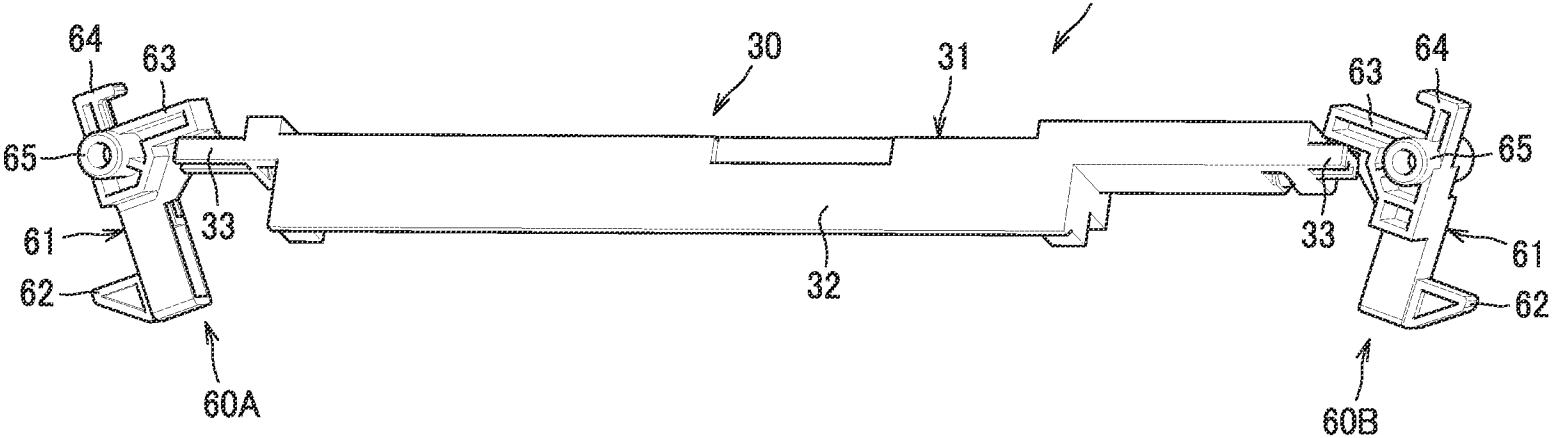
FIG. 8B is a perspective view showing an unlocked state of the locking mechanism.

To open the cover 2, as shown in FIGS. 6B and 8B, the maneuver section 32 of the maneuver lever 30 is pushed up to rotate the maneuver lever 30 about the lever axis X2. By this manipulation, the contact sections 63 of the locking members 60A, 60B are pushed upward by the lever contact portions 33 of the maneuver lever 30. This causes the locking members 60A, 60B to rotate about the axes X3, X4 against biasing forces of the springs 9. As a result of the rotation of the locking members 60A, 60B, the latch sections 62 are disengaged from the corresponding engagement sections 10A making it possible to open the top cover 2.

When the maneuver section 32 is released, the locking members 60A, 60B return to the locked positions by the biasing force of the springs 9. At this point, the stoppers 64 of the locking members 60A, 60B contact corresponding protrusions 2D of the cover 2. In this way, the locking members 60A, 60B are restrained from rotating beyond the protrusions 2D.

When the locking members 60A, 60B rotate from the locked positions to the unlocked positions, the locking members 60A, 60B rotate in such a manner that the latch section 62 of the first locking member 60A and the latch section 62 of the second locking member 60B move closer to each other in the first direction. That is, the first locking member 60A rotates in a counterclockwise direction, and the second locking member 60B rotates in a clockwise direction.

A method for attaching the maneuver lever 30 and the locking members 60A, 60B to the top cover 2 will now be described.

Figure 9A:
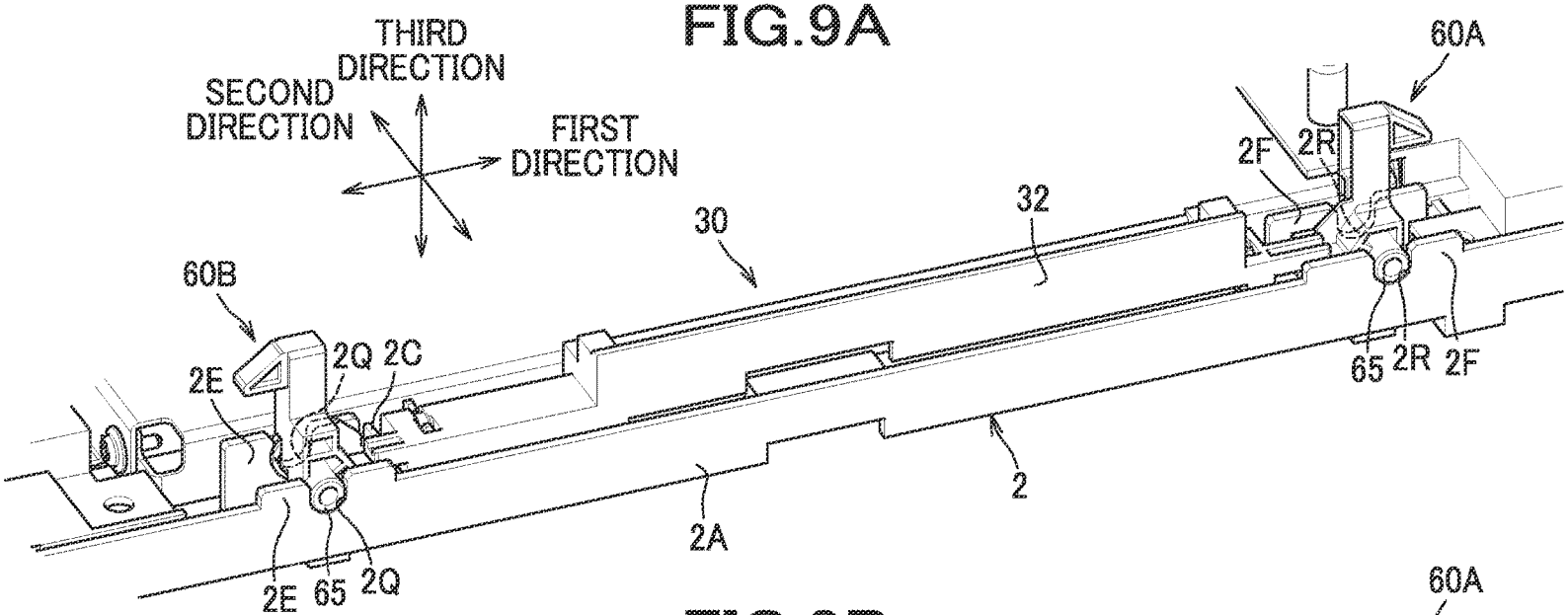
FIG. 9A is a perspective view showing the locking mechanism without a second frame.
Figure 9B:
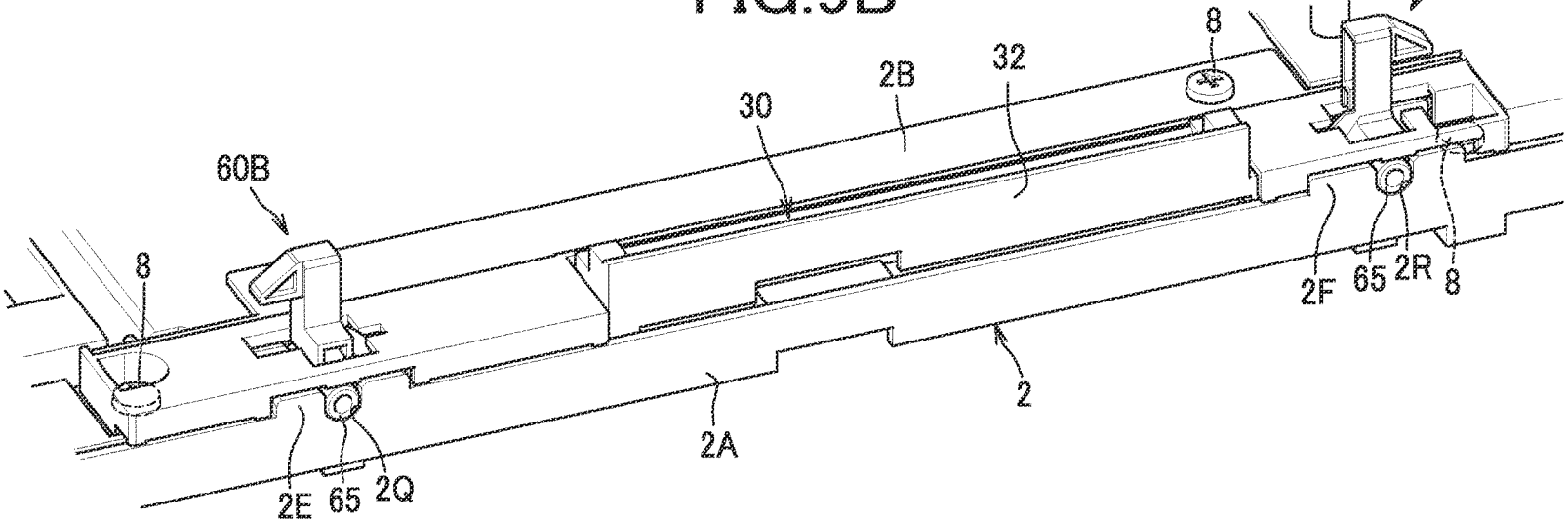
FIG. 9B is a perspective view showing the locking mechanism with the second frame attached thereto.

First, as shown in FIG. 9A, the shaft section 65 of the first locking member 60A is placed in the recesses 2R of the lock supporting sections 2F, and the shaft section 65 of the second locking member 60B is placed in the recesses 2Q of the lock supporting sections 2E. Next, the shafts 31B of the maneuver lever 30 are respectively placed in the recess 2P of the corresponding lever supporting section 2C. At this point, the lever contact sections 33 of the maneuver lever 30 overlap the contact sections 63 of the locking members 60A, 60B, as viewed from a third direction that is perpendicular to the first direction and the second direction. Lastly, as shown in FIG. 9B, the second frame 2B is attached to the first frame 2A by screws 8.

In the illustrative, non-limiting embodiment described above, the following advantageous effects of the lock mechanism 4 for the top cover 2 can be achieved.

When the maneuver section 32 is lifted, the maneuver lever 30 rotates about the lever axis X2 from the closed position to the open position. The locking members 60A, 60B accordingly rotate from the locked positions in which the locking members 60A, 60B engage with the corresponding engagement sections 10A to the unlocked positions in which the locking members 60A, 60B are disengaged from the corresponding engagement sections 10A. Since the axes X3, X4 of the locking members 60A, 60B are perpendicular to the lever axis X2 of the maneuver lever 30, the space necessary for rotation of the locking members 60A, 60B is located inward of the locking members 60A, 60B in the first direction, i.e., inward of the locking members 60A, 60B in the left-right direction of the apparatus. Therefore, the space necessary for movement of the locking members 60A, 60B in a direction perpendicular to the first direction can be reduced.

Further, since the latch section 62 of the first locking member 60A and the latch section 62 of the second locking member 60B rotate in such a manner that they move closer to each other in the first direction when the locking members 60A, 60B rotate from the locked positions to the unlocked positions, the space necessary for movement of the locking members 60A, 60B in the first direction can be reduced compared to the case where the latch sections 62 rotate in such a manner that they move apart from each other or rotate in the same direction.

Also, since the maneuver lever 30 pushes the contact sections 63 of the locking members 60A, 60B upward to rotate the locking members 60A, 60B from the locked positions to the unlocked positions, there is no need of a complicated mechanism and the force necessary to open and close the cover will be reduced compared to, for example, the case where a part is located between the maneuver lever 30 and the locking members 60A, 60B.

Since the locking mechanism 4 comprises springs 9 that bias respective locking members 60A, 60B to the locked positions, the locking members 60A, 60B can be restrained from being disengaged from the corresponding engagement sections 10A and retained in the locked positions.

Since each of the locking members 60A, 60B comprises the stopper 64 that contacts the top cover 2 to stop rotation of the locking members 60A, 60B caused by a biasing force of the respective springs 9, the latch sections 62 of the locking members 60A, 60B are restrained, when the top cover 2 is opened, from rotating beyond a position in which the latch sections 62 are capable of engaging with the housing 10 upon closing the top cover 2.

Since the maneuver lever 30 is rotatable about a lever axis X2 between the closed position and the open position, the force necessary for maneuver is reduced compared to a slide-type maneuver lever, for example.

Since the top cover 2 comprises the first frame 2A and the second frame 2B, and the shafts 31B are held between and supported by the first frame 2A and the second frame 2B, the maneuver lever 30 can be easily attached to the top cover 2. Further, since the shaft sections 65 of the locking members 60A, 60B are held between and supported by the first frame 2A and the second frame 2B, the locking members 60A, 60B can be easily attached to the top cover 2.

The present invention is not limited to the above-described embodiment and may be implemented in various other forms as described below.

The locking members 60A, 60B have a first side and a second side which face away from each other in directions parallel to the first direction. In this description, the first side faces to the left and the second side faces to the right.

Figure 10A:
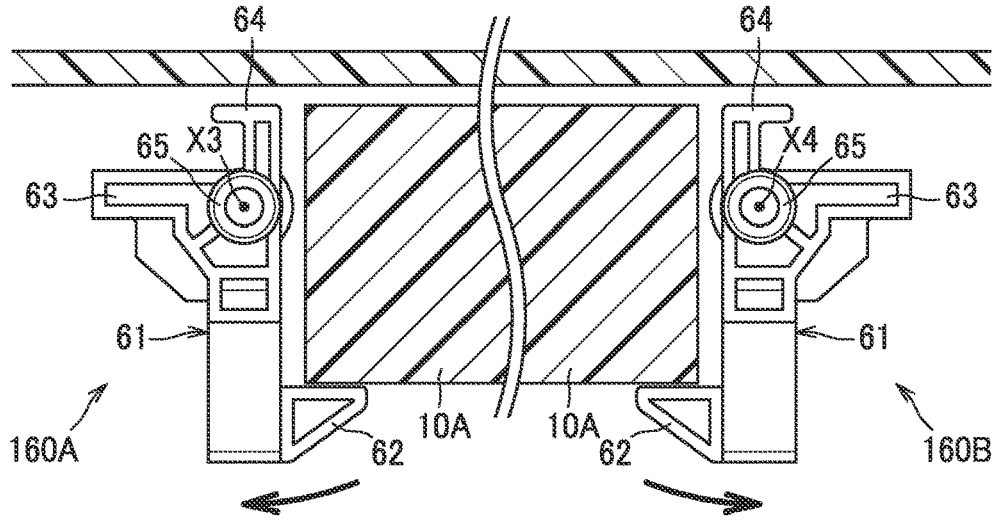
FIG. 10A is a view showing locking members of another embodiment which rotate oppositely and move away from each other from a locked position to an unlocked position.

As shown in FIG. 10A, the locking members may be locking members 160A, 160B that in the locked positions are engaged with engagement sections 10A provided inward of the locking members 160A, 160B in the first direction. When the locking members 160A, 160B rotate from the locked positions to the unlocked positions, the latch sections 62 of the locking members 160A, 160B rotate in such a manner that they move away from each other in the first direction.

Figure 10B:
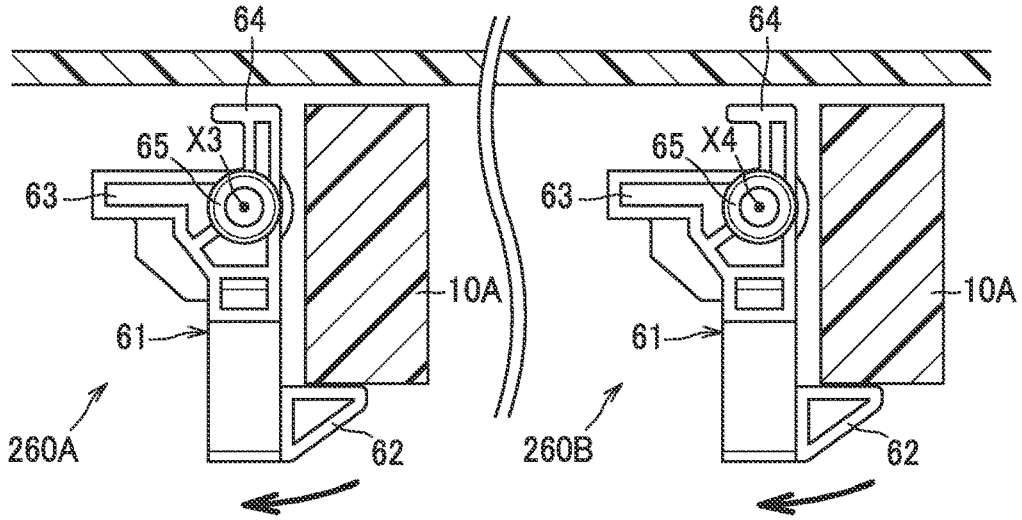
FIG. 10B is a view showing locking members of yet another embodiment which rotate in the clockwise direction from a locked position to an unlocked position.

Further, as shown in FIG. 10B, the locking members may be locking members 260A, 260B that in the locked positions are engaged with engagement sections 10A provided on the second sides of the locking members 260A, 260B. When the locking members 260A, 260B rotate from the locked positions to the unlocked positions, the latch sections 62 of the locking members 260A, 260B rotate clockwise in the same direction.

Figure 10C:
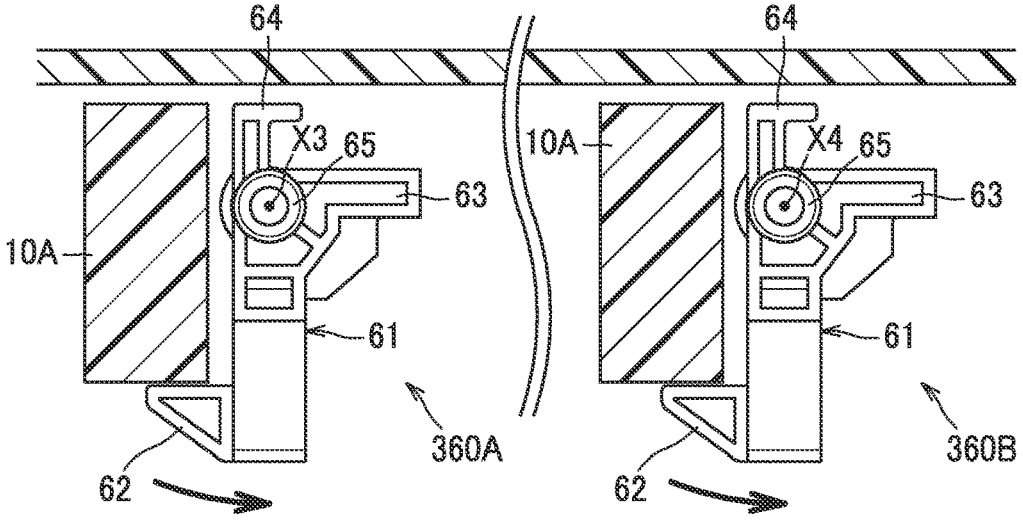
FIG. 10C is a view showing locking members of yet another embodiment which rotate in the counterclockwise direction from a locked position to an unlocked position.

Furthermore, as shown in FIG. 10C, the locking members may be locking members 360A, 360B that in the locked positions are engaged with engagement sections 10A provided on the first sides of the locking members 360A, 360B. When the locking members 360A, 360B rotate from the locked positions to the unlocked positions, the latch sections 62 of the locking members 360A, 360B rotate counterclockwise in the same direction.

Although a color printer 1 is described as an example of an image forming device, the present invention may be applied to monochrome laser printers, copying machines, multifunction machines, etc.

Although the lock mechanism 4 is described as a lock mechanism 4 for a top cover 2, the lock mechanism 4 may be used for other covers.

The elements described in the above embodiment and its modified examples may be implemented selectively and in combination.

What is claimed is:

1. An image forming apparatus comprising:

a housing;

a cover attached to the housing, the cover being rotatable about a rotation axis with respect to the housing;

a maneuver lever attached to the cover and extending in a first direction along a direction in which the rotation axis extends, the maneuver lever being movable between a closed position and an open position, the maneuver lever having a first end and a second end that are located apart from each other in the first direction;

a first locking member attached to the cover and configured to engage with the first end of the maneuver lever, the first locking member being rotatable about a first axis perpendicular to the rotation axis between a locked position and an unlocked position; and a second locking member attached to the cover and configured to engage with the second end of the maneuver lever, the second locking member being rotatable about a second axis parallel to the first axis between a locked position and an unlocked position, wherein when the maneuver lever moves from the closed position to the open position, each of the first locking member and the second locking member rotates from the locked position to the unlocked position, and wherein the maneuver lever is rotatable about a lever axis between the closed position and the open position.

2. The image forming apparatus according to claim 1, wherein the first locking member comprises a contact section that contacts the maneuver lever, wherein the second locking member comprises a contact section that contacts the maneuver lever, and wherein when the maneuver lever moves from the closed position to the open position, the contact sections of the first locking member and the second locking member are pushed by the maneuver lever, which causes the first locking member and the second locking member to rotate.

3. The image forming apparatus according to claim 1, wherein the first locking member comprises a latch section that engages with the housing when the first locking member is in the locked position and is disengaged from the housing when the first locking member is in the unlocked position, wherein the second locking member comprises a latch section that engages with the housing when the second locking member is in the locked position and is disengaged from the housing when the second locking member is in the unlocked position, and wherein when the first locking member and the second locking member rotate from the locked positions to the unlocked positions, the latch section of the first locking member and the latch section of the second locking member rotate in such a manner as to move closer to each other in the direction parallel to the rotation axis.

4. The image forming apparatus according to claim 1, further comprising:

a first spring that biases and causes the first locking member to rotate to the locked position; and a second spring that biases and causes the second locking member to rotate to the locked position.

5. The image forming apparatus according to claim 4, wherein the first locking member comprises a first stopper configured to contact the cover to stop rotation of the first locking member caused by a biasing force of the first spring, and the second locking member comprises a second stopper configured to contact the cover to stop rotation of the second locking member caused by a biasing force of the second spring.

6. The image forming apparatus according to claim 1, wherein the maneuver lever comprises a shaft that is rotatable about the lever axis, and wherein the cover comprises a first frame and a second frame, the shaft being held between the first frame and the second frame.

7. The image forming apparatus according to claim 6, wherein each of the first locking member and the second locking member comprises a shaft section rotatably supported on the cover, the shaft section being held between the first frame and the second frame.

8. The image forming apparatus according to claim 1, wherein the maneuver lever comprises a maneuver section that extends in a direction perpendicular to the rotation axis, a shortest distance between the first end of the maneuver lever and the maneuver section being shorter than a shortest distance between the second end of the maneuver lever and the maneuver section.

9. An image forming apparatus comprising:

a housing;

a cover attached to the housing, the cover being rotatable about a rotation axis with respect to the housing;

a maneuver lever attached to the cover and extending in a first direction along a direction in which the rotation axis extends, the maneuver lever being movable between a closed position and an open position, the maneuver lever having a first end and a second end that are located apart from each other in the first direction;

a first locking member attached to the cover and configured to engage with the first end of the maneuver lever, the first locking member being rotatable about a first axis perpendicular to the rotation axis between a locked position and an unlocked position; and a second locking member attached to the cover and configured to engage with the second end of the maneuver lever, the second locking member being rotatable about a second axis parallel to the first axis between a locked position and an unlocked position, wherein when the maneuver lever moves from the closed position to the open position, each of the first locking member and the second locking member rotates from the locked position to the unlocked position, and wherein the maneuver lever comprises a maneuver section that extends in a direction perpendicular to the rotation axis, a shortest distance between the first end of the maneuver lever and the maneuver section being shorter than a shortest distance between the second end of the maneuver lever and the maneuver section.

10. The image forming apparatus according to claim 9, wherein the first locking member comprises a contact section that contacts the maneuver lever, wherein the second locking member comprises a contact section that contacts the maneuver lever, and wherein when the maneuver lever moves from the closed position to the open position, the contact sections of the first locking member and the second locking member are pushed by the maneuver lever, which causes the first locking member and the second locking member to rotate.

11. The image forming apparatus according to claim 9, wherein the first locking member comprises a latch section that engages with the housing when the first locking member is in the locked position and is disengaged from the housing when the first locking member is in the unlocked position, wherein the second locking member comprises a latch section that engages with the housing when the second locking member is in the locked position and is disengaged from the housing when the second locking member is in the unlocked position, and wherein when the first locking member and the second locking member rotate from the locked positions to the unlocked positions, the latch section of the first locking member and the latch section of the second locking member rotate in such a manner as to move closer to each other in the direction parallel to the rotation axis.

12. The image forming apparatus according to claim 9, further comprising:

a first spring that biases and causes the first locking member to rotate to the locked position; and a second spring that biases and causes the second locking member to rotate to the locked position.

13. The image forming apparatus according to claim 12, wherein the first locking member comprises a first stopper configured to contact the cover to stop rotation of the first locking member caused by a biasing force of the first spring, and the second locking member comprises a second stopper configured to contact the cover to stop rotation of the second locking member caused by a biasing force of the second spring.

14. The image forming apparatus according to claim 9, wherein the maneuver lever is rotatable about a lever axis between the closed position and the open position, wherein the maneuver lever comprises a shaft that is rotatable about the lever axis, and wherein the cover comprises a first frame and a second frame, the shaft being held between the first frame and the second frame.

15. The image forming apparatus according to claim 14, wherein each of the first locking member and the second locking member comprises a shaft section rotatably supported on the cover, the shaft section being held between the first frame and the second frame.

16. An image forming apparatus comprising:

a housing;

a cover attached to the housing, the cover being rotatable about a rotation axis with respect to the housing;

a maneuver lever attached to the cover and extending in a first direction along a direction in which the rotation axis extends, the maneuver lever being movable between a closed position and an open position, the maneuver lever having a first end and a second end that are located apart from each other in the first direction;

a first locking member attached to the cover and configured to engage with the first end of the maneuver lever, the first locking member being rotatable about a first axis perpendicular to the rotation axis between a locked position and an unlocked position;

a second locking member attached to the cover and configured to engage with the second end of the maneuver lever, the second locking member being rotatable about a second axis parallel to the first axis between a locked position and an unlocked position;

a first spring that biases and causes the first locking member to rotate to the locked position; and a second spring that biases and causes the second locking member to rotate to the locked position, wherein when the maneuver lever moves from the closed position to the open position, each of the first locking member and the second locking member rotates from the locked position to the unlocked position, and wherein the first locking member comprises a first stopper configured to contact the cover to stop rotation of the first locking member caused by a biasing force of the first spring, and the second locking member comprises a second stopper configured to contact the cover to stop rotation of the second locking member caused by a biasing force of the second spring.

17. The image forming apparatus according to claim 16, wherein the first locking member comprises a contact section that contacts the maneuver lever, wherein the second locking member comprises a contact section that contacts the maneuver lever, and wherein when the maneuver lever moves from the closed position to the open position, the contact sections of the first locking member and the second locking member are pushed by the maneuver lever, which causes the first locking member and the second locking member to rotate.

18. The image forming apparatus according to claim 16, wherein the first locking member comprises a latch section that engages with the housing when the first locking member is in the locked position and is disengaged from the housing when the first locking member is in the unlocked position, wherein the second locking member comprises a latch section that engages with the housing when the second locking member is in the locked position and is disengaged from the housing when the second locking member is in the unlocked position, and wherein when the first locking member and the second locking member rotate from the locked positions to the unlocked positions, the latch section of the first locking member and the latch section of the second locking member rotate in such a manner as to move closer to each other in the direction parallel to the rotation axis.

* * * * *